US011117063B2

(12) United States Patent
Cai

(10) Patent No.: US 11,117,063 B2
(45) Date of Patent: Sep. 14, 2021

(54) TOY CAPABLE OF IMPLEMENTING SECOND COIN CLAMPING

(71) Applicants: ALPHA GROUP CO., LTD, Shantou (CN); GUANGDONG AULDEY ANIMATION & TOY CO., LTD, Guangzhou (CN); GUANGZHOU ALPHA CULTURE COMMUNICATIONS CO., LTD, Guangzhou (CN)

(72) Inventor: Dongqing Cai, Shantou (CN)

(73) Assignees: ALPHA GROUP CO., LTD., Guangdong (CN); GUANGDONG AULDEY ANIMATION & TOY CO., LTD., Guangdong (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 95 days.

(21) Appl. No.: 16/313,797

(22) PCT Filed: Aug. 8, 2016

(86) PCT No.: PCT/CN2016/093901
§ 371 (c)(1),
(2) Date: Mar. 22, 2019

(87) PCT Pub. No.: WO2018/000522
PCT Pub. Date: Jan. 4, 2018

(65) Prior Publication Data

US 2019/0201798 A1 Jul. 4, 2019

(30) Foreign Application Priority Data

Jun. 27, 2016 (CN) ..... 201610493577.X

(51) Int. Cl.
*A63H 17/00* (2006.01)

(52) U.S. Cl.
CPC ..... *A63H 17/004* (2013.01); *A63H 17/00* (2013.01)

(58) Field of Classification Search
CPC ..... A63H 17/00; A63H 17/02; A63H 17/004; A63H 17/08; A63H 17/26; A63H 33/003
(Continued)

(56) References Cited

U.S. PATENT DOCUMENTS 1,846,823 A * 2/1932 Westberg ..... A63H 29/02 446/437
3,772,824 A * 11/1973 Terzian ..... A63H 29/04 446/429

(Continued)

FOREIGN PATENT DOCUMENTS

CN 204233757 U 10/2014
CN 204709791 U 5/2015

(Continued)

OTHER PUBLICATIONS

International Search Report for PCT/CN2016/093901, dated Mar. 31, 2017.

(Continued)

*Primary Examiner* — Joseph B Baldori
(74) *Attorney, Agent, or Firm* — B. Aaron Schulman, Esq.; Stites & Harbison, PLLC

(57) ABSTRACT

A toy capable of implementing second coin clamping (100) includes a fixing member (1) and a first unfolding assembly (4). The first unfolding assembly (4) is foldably provided on the fixing member (1). The first unfolding assembly (4) includes a first triggering member (41) and a first elastic member that makes the first unfolding assembly (4) be in an unfolded state. When the first triggering member (41) is
(Continued)

triggered, the first unfolding assembly (4) is unfolded so that a second triggering member (11) on the fixing member (1) can be triggered.

15 Claims, 13 Drawing Sheets

(58) Field of Classification Search
USPC ..... 446/130, 431, 437, 441, 465, 470
See application file for complete search history.

(56) References Cited

U.S. PATENT DOCUMENTS 4,591,346 A * 5/1986 Ikeda ..... A63H 17/004 446/437
5,816,888 A * 10/1998 Myers ..... A63H 17/004 446/456
6,672,937 B1 * 1/2004 Motosko ..... A63H 17/26 446/431
8,777,689 B1 * 7/2014 Neal ..... A63H 17/262 446/441
8,784,153 B2 * 7/2014 Sugimoto ..... A63H 33/003 446/72
10,814,240 B2 * 10/2020 Cai ..... A63H 17/02
2007/0259591 A1 * 11/2007 Dunham ..... A63H 17/004 446/6
2013/0109270 A1 * 5/2013 Martinez ..... A63H 13/00 446/320
2013/0239935 A1 * 9/2013 Martinez ..... F41B 15/00 124/4
2013/0324001 A1 * 12/2013 Yamada ..... A63H 3/003 446/72
2015/0050859 A1 * 2/2015 Choi ..... A63F 1/06 446/72
2016/0045835 A1 * 2/2016 Choi ..... A63F 1/00 446/456
2016/0325198 A1 * 11/2016 Cai ..... A63H 17/02
2018/0133612 A1 * 5/2018 Choi ..... A63H 33/003
2018/0147502 A1 * 5/2018 Choi ..... A63H 33/003
2018/0169537 A1 * 6/2018 Choi ..... A63H 3/04
2019/0201798 A1 * 7/2019 Cai ..... A63H 17/006
2020/0030709 A1 * 1/2020 Cai ..... A63H 17/02
2020/0139258 A1 * 5/2020 Cai ..... A63H 17/262

FOREIGN PATENT DOCUMENTS

CN 205832603 U 5/2015
JP 2014033719 2/2014
KR 20150069570 6/2015

OTHER PUBLICATIONS

Written Opinion for PCT/CN2016/093901, dated Mar. 31, 2017.
Office Action dated Feb. 3, 2020 in equivalent Korean application 10-2019-7002657, with English translation.

* cited by examiner

TOY CAPABLE OF IMPLEMENTING SECOND COIN CLAMPING

FIELD

The present application relates to a field of toys, more particularly to a toy.

BACKGROUND

In the related art, a toy vehicle can usually implement a function of coin clamping once, which is a little boring.

SUMMARY

The present application aims to solve at least one of the technical problems existing in the related art at least to some extent. Accordingly, the present application proposes a toy that is very interesting.

The toy according to the present application includes: a fixing member; and a first unfolding assembly, configured to be foldable and disposed on the fixing member, and including a first triggering member and a first elastic member that allows the first unfolding assembly to be in an unfolded state. When the first triggering member is triggered, the first unfolding assembly is unfolded such that a second triggering member on the fixing member can be triggered.

The toy according to the present application is highly interesting.

In some embodiments, the first unfolding assembly further includes a first locking member, and the first locking member is switchable between a locking state where the first locking member cooperates with the fixing member in a locked manner to fold the first unfolding assembly and an unlocking state where the first locking member is separated from the fixing member to unfold the first unfolding assembly.

In some embodiments, the toy further includes a first contact body. The first contact body and the first triggering member are both magnetically attractable; when the first triggering member and the first contact body are magnetically attracted to each other, the first triggering member is triggered by the first contact body; and when the first triggering member is triggered, one of the first contact body and the first triggering member is moved relative to the fixing member to drive the first locking member to switch to the unlocking state.

In some embodiments, the toy further includes a lock hole located below the fixing member. The first locking member is configured as a lock hook normally fitted with an edge of the lock hole in the locked manner, and when the first triggering member is triggered, the first contact body pushes the lock hook out of the lock hole to unlock.

In some embodiments, the fixing member has a limiting baffle, the first locking member is configured as a movable snapping member normally abutting against under the limiting baffle, and when the first triggering member is triggered, the first triggering member drives the movable snapping member to be separated from under the limiting baffle to unlock.

In some embodiments, the fixing member is provided with a limiting groove in each of a left side and a right side of the fixing member. The first locking member includes: a limiting part, including two limiting blocks spaced apart from each other in a left-and-right direction, and an elastic member connected between the two limiting blocks, the elastic member normally pushing the two limiting blocks away from each other to be fitted with the two limiting grooves respectively, so as to achieve locking; and a moving part, configured in such a way that when the moving part pushes the two limiting blocks, the two limiting blocks compress the elastic member to approach each other to be separated from the two limiting grooves respectively to achieve unlocking.

In some embodiments, each of the limiting blocks has a guide rail extending obliquely from the rear to the front towards a direction close to a perpendicular bisector of the elastic member. The moving part is provided with a pushing portion fitted with an outer side of the guide rail of each of the limiting blocks. The pushing portion pushes the two limiting blocks to approach each other in the left-and-right direction when moving backwards along the guide rail.

In some embodiments, the toy further includes a first flipping member pivotally provided to the fixing member, and configured to pivot to allow the fixing part to flip over in the air when the first triggering member is triggered.

In some embodiments, the toy further includes a second flipping member pivotally provided to the fixing member, and configured to pivot to allow the fixing part to flip over in the air when the second triggering member is triggered.

In some embodiments, the toy further includes a second unfolding assembly configured to be foldable and disposed on the fixing member and configured to be triggered to unfold when the second flipping member flipping over.

In some embodiments, the toy further includes a second locking member movably provided to the fixing member and configured to be switchable between a locking state where the second locking member cooperates with the second unfolding assembly in a locked manner to fold the second unfolding assembly and an unlocking state where the second locking member is separated from the second unfolding assembly to unfold the second unfolding assembly.

Additional aspects and advantages of embodiments of the present disclosure will be given in part in the following descriptions, become apparent in part from the following descriptions, or be learned from the practice of the embodiments of the present disclosure.

Figure 1:
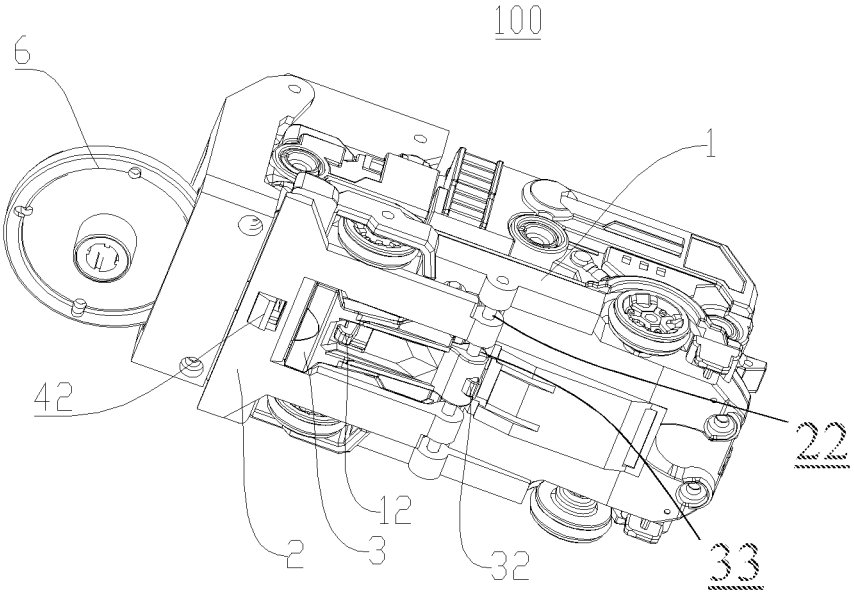
FIG. 1 illustrates a bottom perspective view of a toy in its original form according to a first embodiment of the present application.

REFERENCE NUMERALS toy 100, fixing member 1, second clamping aperture 10, second triggering member 11, hook 12, limiting groove 12B, limiting baffle 12C, moving member 13, first toggling portion 131, first snapping hook 132A, second snapping hook 132B, snapping piece 132C, first flipping member 2, lock hole 21, first torsion spring 22, second flipping member 3, hole 31, second toggling portion 32, second torsion spring 33, first unfolding assembly 4, first clamping aperture 40, first triggering member 41, lock hook 42, moving part 431, pushing portion 4311, limiting part 432, limiting block 4321, guide rail 43210, elastic member 4322, movable snapping member 433, first elastic member 44, second unfolding assembly 5, branch portion 50, first snapping hole 51, second snapping hole 52, snapping groove 53, second elastic member 54, first contact body 6, second contact body 7.

DETAILED DESCRIPTION

Embodiments of the present application will be described in detail, and examples of the embodiments will be illustrated in the drawings, in which the same or similar reference numerals indicate the same or similar elements or the elements having the same or similar functions. The embodiments described below with reference to drawings are illustrative, and used to generally understand the present application. The embodiments shall not be construed to limit the present application.

The following disclosure provides many different embodiments or examples to implement different structures of the present application. In order to simplify the disclosure of the present application, components and arrangements of specific examples are described below. Certainly, they are merely examples and are not intended to limit the application. Furthermore, the present application may repeat reference numerals and/or letters in different examples. This repetition is for the purpose of simplicity and clarity, and does not indicate the relationship among the various embodiments and/or arrangements discussed. Moreover, the present application provides examples of various specific processes and materials, but those skilled in the art will appreciate the applicability of other processes and/or the use of other materials.

A toy 100 according to embodiments of the present application will be described below with reference to the drawings.

As illustrated in the drawings, the toy 100 according to embodiments of the present application includes a fixing member 1, a second flipping member 3, a first unfolding assembly 4, a first contact body 6, and a second contact body 7. It should be noted herein that, the toy 100 may not include the first contact body 6 and the second contact body 7, and for example, a player can instead adopt other household items, such as sheet iron, coins, etc.

In a specific example of the present application, the toy 100 can be a toy vehicle, in which case the fixing member 1 can be a vehicle frame or a vehicle frame with a wheel. The second flipping member 3 is pivotally provided to the fixing member 1, that is, the second flipping member 3 is pivotable relative to the fixing member 1. For instance, the second flipping member 3 can be connected with the fixing member 1 through a pivot shaft, such that the second flipping member 3 can pivot through the pivot shaft relative to the fixing member 1.

Specifically, when the second flipping member 3 pivots relative to the fixing member 1, the second flipping member 3 can interact with a supporting surface (e.g., the ground) where the fixing member 1 is placed, to make the fixing member 1 flip over in the air. For example, when the second flipping member 3 pivots from the front to the rear with respect to the fixing member 1 via a lower side of the fixing member 1, the fixing member 1 carrying the second flipping member 3 can be flipped backwards in the air by means of the interaction between the second flipping member 3 and the supporting surface. Therefore, during the forward movement of the fixing member 1 with respect to the supporting surface, when the fixing member 1 is flipped backwards in the air (i.e., back flip), the fixing member 1 may have a forward inertial force to continue to move forwards after the flip in the air.

It should be noted that, the second flipping member 3 can be connected with the fixing member 1 through a second torsion spring 33; when the second flipping member 3 is constrained (for example, locked by a third locking member described below), the torsion spring 33 is compressed to accumulate an elastic force; and when the second flipping member 3 is unconstrained (for example, unlocked by the third described below), the second torsion spring 33 restores the deformation to release the elastic force, such that the second flipping member 3 is flipped over.

The fixing member 1 has a second triggering member 11, and the second triggering member 11 can initially present two states, namely, a triggerable state and an untriggerable state. For example, when the second triggering member 11 is exposed, the triggerable state can be presented, and when the second triggering member 11 is covered, the untriggerable state can be presented. That is, the second triggering member 11 can be covered and hidden, and the second triggering member 11 can also be exposed. When the second triggering member 11 is covered and hidden, the second triggering member 11 cannot be triggered; when the second triggering member 11 is exposed, the second triggering member 11 can be triggered. For example, the second triggering member 11 can be triggered by the second contact body 7.

For example, the second contact body 7 may be magnetically attractable, and the second triggering member 11 may also be magnetically attractable. When the second contact body 7 and the second triggering member 11 are magnetically attracted to each other, and at least one of the second contact body 7 and the second triggering member 11 is displaced by the magnetic attraction, the second triggering member 11 is triggered by the second contact body 7.

The first unfolding assembly 4 is configured to cover and hide the second triggering member 11, so that the second triggering member 11 cannot be triggered. Specifically, the first unfolding assembly 4 is provided on the fixing member 1 in a foldable manner. Specifically, the first unfolding assembly 4 can be directly or indirectly provided on the fixing member 1. For example, the first unfolding assembly 4 can be indirectly provided on the fixing member 1 through a second unfolding assembly 5 described below, and can be switched between a collapsed state where the first unfolding assembly 4 is collapsed on the fixing member 1 and an unfolded state. When the first unfolding assembly 4 is in the collapsed state, the first unfolding assembly 4 can cover and hide the second triggering member 11.

The first unfolding assembly 4 includes a first elastic member 44 that causes the first unfolding assembly 4 to assume an unfolded state. Specifically, the first unfolding assembly 4 can include at least one structural component, and the structural component can be connected with another component (e.g., the fixing member 1 or the second unfolding assembly 5), on which the structural component is directly or indirectly disposed, by means of the first elastic member 44 (for example, a torsion spring). Different structural components may also be connected by the first elastic member 44 (for example, a torsion spring). Thus, when the structural component is constrained (for example, locked by a first locking member described below), the first elastic member 44 is compressed by the structural component to accumulate the elastic force, in which case the first unfolding assembly 4 assumes the collapsed state. When the structural component is unconstrained (for example, unlocked by the first locking member as described below), the first elastic member 44 can restore the deformation and release the elastic force, in which case different structural components can be separated by the elastic force of the first elastic member 44, and the structural component and another component on which the structural component is directly or indirectly disposed can also be separated by the elastic force of the first elastic member 44, so that the first unfolding assembly 4 assumes the unfolded state.

Further, the first unfolding assembly 4 includes a first triggering member 41 that initially can only assume a triggerable state. For example, the triggerable state can be presented when the first triggering member 41 is exposed. That is, the first triggering member 41 is not covered, but is in a state of being exposed and to be triggered. For instance, the first triggering member 41 can be triggered by the first contact body 6. For example, the first contact body 6 may be magnetically attractable, and the first triggering member 41 may also be magnetically attractable. When the first contact body 6 and the first triggering member 41 are magnetically attracted to each other, and at least one of the first contact body 6 and the first triggering member 41 is displaced by the magnetic attraction, the first triggering member 41 is triggered by the first contact body 6.

When the first triggering member 41 is triggered, the first unfolding assembly 4 is unfolded to expose the second triggering member 11. For example, when the first contact body 6 triggers the first triggering member 41, the first locking member can be unlocked, and the structural component in the first unfolding assembly 4 is unconstrained. Under the action of the first elastic member 44, the first unfolding assembly 4 can be switched from the collapsed state to the unfolded state. At this time, the first unfolding assembly 4 no longer covers and hides the second triggering member 11, so that the second triggering member 11 assumes a state of being uncovered, exposed, and to be triggered.

When the second triggering member 11 is triggered, the second flipping member 3 pivots to cause the fixing member 1 to flip over in the air. For example, when the second contact body 7 triggers the second triggering member 11, the third locking member can be unlocked, and the second flipping member 3 can pivot relative to the fixing member 1 without being constrained, so that the fixing member 1 carrying the second flipping member 3, the first unfolding assembly 4 and the like, can be flipped over in the air during the pivoting of the second flipping member 3 relative to the fixing member 1.

It should be noted that, the phrase "the first triggering member 41 assuming an exposed state" be interpreted broadly. That is, as long as the first triggering member 41 can be triggered by the first contact body 6 (for example, the first contact body 6 approaches the first triggering member 41), it should be understood that the first triggering member 41 is in the exposed state. For example, in one embodiment of the present application, the first unfolding assembly 4 includes a first body portion, and the first body portion has a first clamping aperture 40. For instance, the first clamping aperture 40 can be formed in such a way that a lower portion of a front end surface of the first body portion backwardly extends through, and the first triggering member 41 is provided in the first body portion and adjacent to the first clamping aperture 40. Therefore, when the first clamping aperture 40 is not blocked, the first contact body 6 can approach the first triggering member 41, so that the first triggering member 41 can be triggered by the first contact body 6, whereby the first triggering member 41 should be understood to present the exposed state.

Certainly, the present application is not limited thereto. In other embodiments of the present application, at least a part of the first triggering member 41 can also protrude out of the first body portion through the first clamping aperture 40 to be triggered by the first contact body 6. However, when the first triggering member 41 is located in the first body portion and adjacent to the first clamping aperture 40, the first contact body 6 can be clamped at the first clamping aperture 40 after triggering the first triggering member 41, so as to prevent the first contact body 6 from being bounced off after the first triggering member 41 is triggered and hence from damaging people or objects around, which enhances the safety of the play, and improves the overall aesthetics of the toy 100. It should be noted herein that there are many ways of clamping the first contact body 6, and for example, the first contact body 6 may be clamped at the first clamping aperture 40 by a clamping assembly known in the related art, which will not be elaborated herein.

Likewise, the phrase "the second triggering member 11 assuming an exposed state" should be interpreted broadly. That is, as long as the second triggering member 11 can be triggered by the second contact body 7 (for example, the second contact body 7 approaches the second triggering member 11), it should be understood that the second triggering member 11 is in the exposed state. For example, in one embodiment of the present application, the fixing member 1 includes a body portion, and the body portion has a second clamping aperture 10. For instance, the second clamping aperture 10 can be formed in such a way that a front end surface of the body portion backwardly extends through, and the second triggering member 11 is provided in the body portion and adjacent to the second clamping aperture 10. Therefore, when the second clamping aperture 10 is not blocked, the second contact body 7 can approach the second triggering member 11, so that the second triggering member 11 can be triggered by the second contact body 7, whereby the second triggering member 11 should be understood to present the exposed state.

Certainly, the present application is not limited thereto. In other embodiments of the present application, at least a part of the second triggering member 11 can also protrude out of the body portion through the second clamping aperture 10 to be triggered by the second contact body 7. However, when the second triggering member 11 is located in the body portion and adjacent to the second clamping aperture 10, the second contact body 7 can be clamped at the second clamping aperture 10 after triggering the second triggering member 11, so as to prevent the second contact body 7 from being bounced off after the second triggering member 11 is triggered and hence from damaging people or objects around, which enhances the safety of the play, and improves the overall aesthetics of the toy 100. It should be noted herein that there are many ways of clamping the second contact body 7, and for example, the second contact body 7 may be clamped at the second clamping aperture 10 by a clamping assembly known in the related art, which will not be elaborated herein.

Certainly, the present application is not limited thereto. In other embodiments of the present application, the toy 100 may not include the second flipping member 3, and after the second triggering member 11 is triggered, the toy 100 can no longer respond to the second flip in the air, but may make other responses. For example, when the toy includes a music device or a light-emitting device, after the second triggering member 11 is triggered, the toy may make a response, such as playing music or emitting light.

A way of playing with the toy 100 according to a specific example of the present application will be described below.

The first contact body 6 is placed in front of the fixing member 1, the second contact body 7 is placed in front of the first contact body 6, and the fixing member 1 is pushed forwards. During the forward movement of the fixing member 1, the first contact body 6 may first come into contact with the fixing member 1 to preferentially trigger the first triggering member 41 in the exposed state. When the first triggering member 41 is triggered, the first unfolding assembly 4 may be unfolded to expose the second triggering member 11.

The fixing member 1 can continue to move forwards under the action of its inertial force, and then comes into contact with the second contact body 7 in front of it. At this time, the second contact body 7 can trigger the exposed second triggering member 11. After the second triggering member 11 is triggered, the second flipping member 3 can pivot relative to the fixing member 1. Through the interaction between the second flipping member 3 and the supporting surface, the fixing member 1 can be back-flipped, and the fixing member 1 continues to move forwards under the action of its inertial force after landing.

Therefore, the toy 100 according to the embodiment of the present application can be triggered twice, and thus be more interesting.

In one embodiment of the present application, the toy 100 further includes, a first flipping member 2 that is pivotally provided to the fixing member 1. That is, the first flipping member 2 is pivotable relative to the fixing member 1, and for example, the first flipping member 2 can be connected to the fixing member 1 by a pivot shaft, so that the first flipping member 2 can pivot relative to the fixing member 1 by the pivot shaft.

Specifically, when the first flipping member 2 pivots relative to the fixing member 1, the first flipping member 2 can interact with the supporting surface (e.g., the ground) on which the fixing member 1 is placed, so that the fixing member 1 is flipped over in the air. For example, when the first flipping member 2 pivots relative to the fixing member 1 from the front to the rear via a lower side of the fixing member 1, the fixing member 1 carrying the first flipping member 2 can be flipped backward in the air by the interaction of the first flipping member 2 with the supporting surface. In this way, during the forward movement of the fixing member 1 with respect to the supporting surface, when the fixing member 1 is flipped backwards in the air (i.e., the back flip), the fixing member 1 may have a forward inertial force to continue to move forwards after the flip in the air.

It should be noted herein that the first flipping member 2 can be connected to the fixing member 1 by a first torsion spring 22; when 2 is constrained (for example, locked by a lock hook 42 described below), the first torsion spring 22 is compressed to accumulate an elastic force; and when the first flipping member 2 is unconstrained (for example, unlocked by the lock hook 42 described below), the first torsion spring 22 restores the deformation to release the elastic force, thereby causing the first flipping member 2 to pivot.

In one embodiment of the present application, the toy 100 further includes a second unfolding assembly 5 that is provided on the fixing member 1 in a foldable manner. Specifically, the second unfolding assembly 5 can be directly or indirectly disposed on the fixing member 1 and can be switched between a collapsed state where the second unfolding assembly 5 is collapsed on the fixing member 1 and an unfolded state.

The second unfolding assembly 5 includes a second elastic member 54 that causes the second unfolding assembly 5 to assume an unfolded state. Specifically, the second unfolding assembly 5 can include at least one structural component (e.g., a branch portion 50 described below), and the structural component can be connected with another component (e.g., the fixing member 1), on which the structural component is directly or indirectly disposed, by means of the second elastic member 54 (for example, a torsion spring). Different structural components may also be connected by the second elastic member 54 (for example, a torsion spring). Thus, when the structural component is constrained (for example, locked by a second locking member described below), the second elastic member 54 is compressed by the structural component to accumulate an elastic force, in which case the second unfolding assembly 5 assumes the collapsed state. When the structural component is unconstrained (for example, unlocked by the second locking member as described below), the second elastic member 54 can restore the deformation and release the elastic force, in which case different structural components can be separated by the elastic force of the second elastic member 54, and the structural component and another component (e.g., the fixing member 1) on which the structural component is directly or indirectly disposed can also be separated by the elastic force of the second elastic member 54, so that the second unfolding assembly 5 assumes the unfolded state.

Further, the second unfolding assembly 5 is triggered to unfold during the flipping of the second flipping member 3. For instance, during the flipping of the second flipping member 3, the second locking member can be unlocked, and at this time, the structural component in the second unfolding assembly 5 is unconstrained. Under the action of the second elastic member 54, the second unfolding assembly 5 can be switched from the collapsed state to the unfolded state, thereby improving the entertainment of the toy 100.

Specific implementations about the triggering of the first triggering member 41, the unlocking of the first locking member, the unfolding of the first unfolding assembly 4, and the pivoting of the first flipping member 2 according to embodiments of the present application will be briefly described below.

In an embodiment of the present application, the first unfolding assembly 4 further includes a first locking member, and the first locking member is switchable between a locking state where the first locking member cooperates with the fixing member 1 in a locked manner to fold the first unfolding assembly 4 and an unlocking state where the first locking member is separated from the fixing member 1 to unfold the first unfolding assembly 4.

That is, the first locking member is switchable between the locking state and the unlocking state. When the first locking member assumes the locking state, the first locking member cooperates with the fixing member 1 in the locked manner to constrain the first unfolding assembly 4, such that the first unfolding assembly 4 can assume the collapsed state. When the first locking member assumes the unlocking state, the first locking member is separated from the fixing member 1 to release the constraint on the first unfolding assembly 4, such that the first unfolding assembly 4 can assume the unfolded state.

Therefore, the unfolding and folding of the first unfolding assembly 4 can be controlled by the associated action of the first triggering member 41 and the first locking member in the first unfolding assembly 4, thereby achieving simple, highly modular and reliable action. After the first unfolding assembly 4 is unfolded, both the first triggering member 41 and the first locking member can be well integrated in the first unfolding assembly 4, with no influence on the overall shape of the toy 100.

Certainly, the present application is not limited thereto. In other embodiments of the present application, the unfolding and folding of the first unfolding assembly 4 can be controlled in other ways, and for example, the first unfolding assembly 4 can be locked and unlocked by a locking structure or the like outside the fixing member 1.

Specifically, when the first triggering member 41 and the first contact body 6 are magnetically attracted to each other to cause relative movement, the first triggering member 41 is triggered by the first contact body 6. Thus, when the first triggering member 41 is triggered, since the first triggering member 41 and the first contact body 6 are relatively movable, one of the first contact body 6 and the first triggering member 41 can move relative to the fixing member 1 and drive (e.g., brings or push) the first locking member to switch to the unlocked state. Hence, alternative embodiments can be extended in the following two aspects.

An alternative embodiment in one of the above aspects will be described in brief. The first triggering member 41 is movably provided in the first body portion. When the first triggering member 41 and the first contact body 6 are magnetically attracted to each other, and the first contact body 6 is locked at the first clamping aperture 40 and is stationary, the first contact body 6 can attract the first trigger member 41 to move towards the first contact body 6, for example, to move forwardly towards the exterior of the first clamping aperture 40, and at this time, the moving first triggering member 41 can drive the first locking member to perform an unlocking action, so that the first locking member releases the constraint on the first unfolding assembly 4 to allow the first unfolding assembly 4 to unfold.

Figure 21:
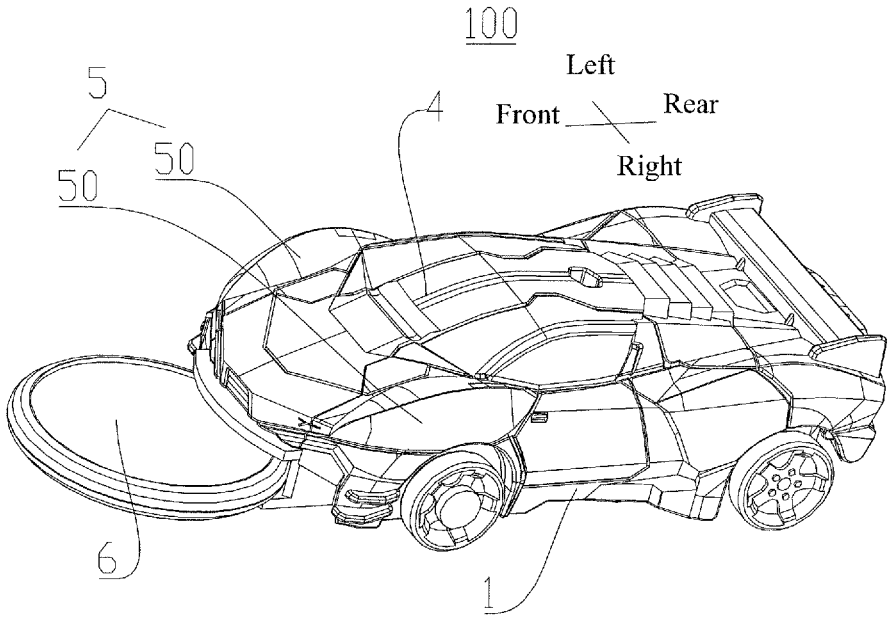
FIG. 21 illustrates a top perspective view of a toy in its original form according to a third embodiment of the present application.
Figure 22:
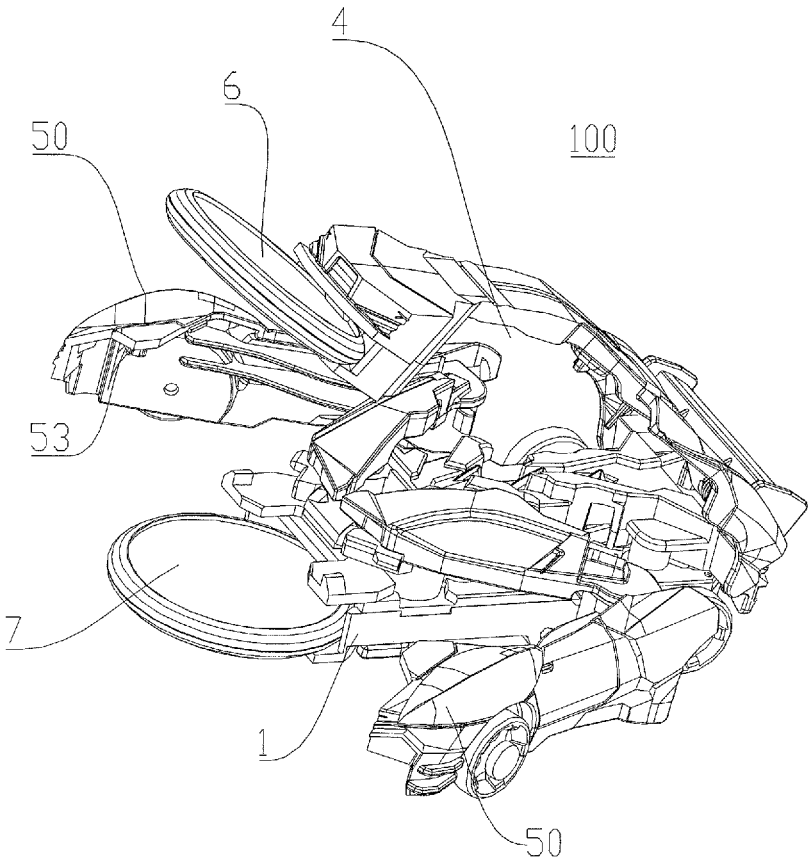
FIG. 22 illustrates a top perspective view of the toy in FIG. 21 after being triggered twice.
Figure 23:
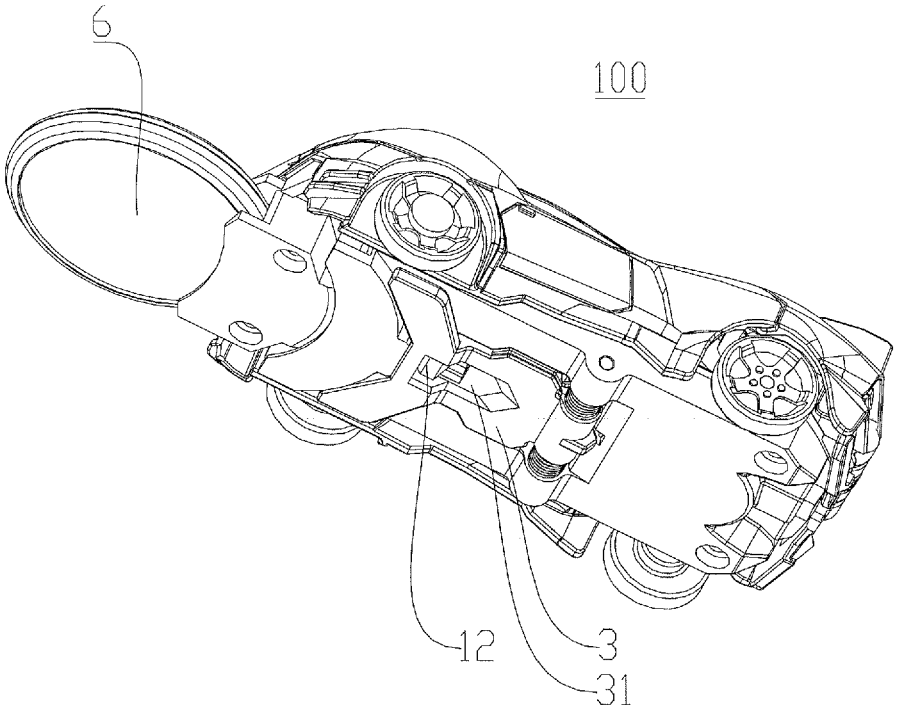
FIG. 23 illustrates a bottom perspective view of the toy in its original form shown in FIG. 21.
Figure 24:
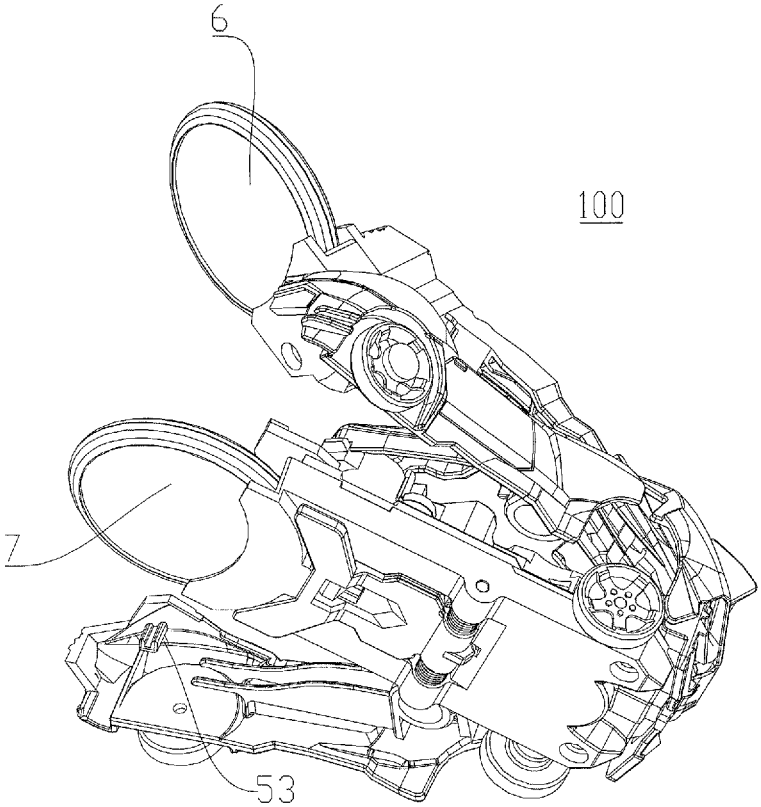
FIG. 24 illustrates a bottom perspective view of the toy in FIG. 22 after being triggered twice, in which a second flipping member is in a locked state before being flipped over.
Figure 25:
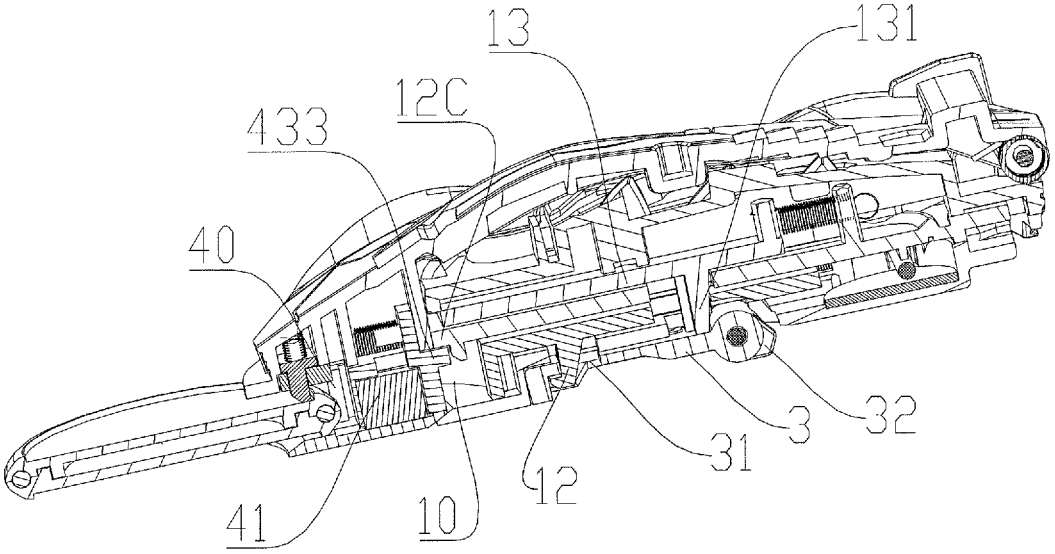
FIG. 25 illustrates a sectional view of the toy in FIG. 21.
Figure 26:
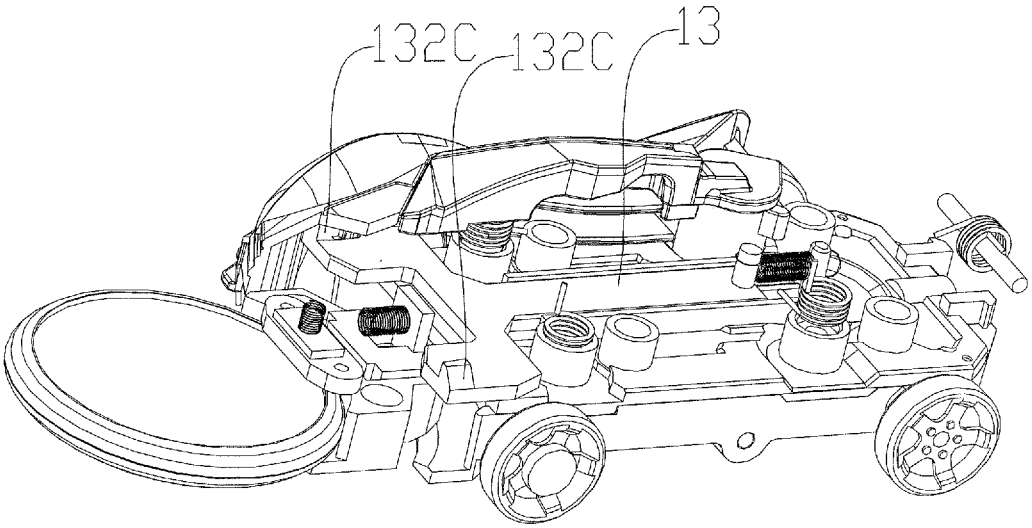
FIG. 26 illustrates a sectional view of the toy in FIG. 22.

In a specific example (as shown in a third embodiment below, referring to FIGS. 21-26), the fixing member 1 has a limiting baffle 12C, and the first locking member is configured as a movable snapping member 433 that normally abuts against a lower side of the limiting baffle 12C. When the first triggering member 41 is triggered, the first triggering member 41 drives the movable snapping member 433 to be separated from the lower side of the limiting baffle 12C to achieve unlocking, such that the first unfolding component 4 can pivot upwards and be lifted relative to the fixing member 1, so as to unfold.

For example, the first triggering member 41 may be a magnet and mounted in the movable snapping member 433 to be disposed in the first body portion and movable in synchronization with the movable snapping member 433 in a front-and-back direction. When the first contact body 6 attracts the first triggering member 41 to move forwardly, the first triggering member 41 drives the movable snapping member 433 fitted over it to move forwards. The movable snapping member 433 moves forwards from the lower side of the limiting baffle 12C to the top of the movable snapping member 433 and hence is no longer blocked by the limiting baffle 12C. At this time, the limiting baffle 12C loses the constraint on the movable snapping member 433, and the first unfolding assembly 4 can be unfolded under the action of the first elastic member 44. For example, the first unfolding assembly 4 can be unfolded into a shape of a scorpion tail that is raised upwards at the front.

Additionally, it should be noted that the phrase "the movable snapping member 433 normally abutting against the lower side of the limiting baffle 12C" means that before the movable snapping member 433 is unlocked, the movable snapping member 433 is in a position where the first unfolding assembly 4 is permanently locked. For example, the movable snapping member 433 can be movably connected to the first body portion through a reset spring, and the reset spring flicks the movable snapping member 433 to make the movable snapping member 433 normally located below the limiting baffle 12C. When the first triggering member 41 drives the movable snapping member 433 to move forwards, the movable snapping member 433 can stretch or compress the reset spring, such that the reset spring is deformed and accumulates an elastic force. When the first contact body 6 no longer attracts the first triggering member 41, and the first unfolding assembly 4 is collapsed on the fixing member 1, the reset spring can push the movable snapping member 433 to abut against the lower side of the limiting baffle 12C again, and the first unfolding assembly 4 is locked again.

An alternative embodiment in the other one of the above aspects will be described in brief. The first triggering member 41 is fixedly provided in the first body portion. When the first triggering member 41 and the first contact body 6 are magnetically attracted to each other, the first triggering member 41 can attract the first contact body 6 to move towards the first triggering member 41, for example, to move backwardly towards the interior of the first clamping aperture 40, and at this time, the moving first contact body 6 can drive the first locking member to perform an unlocking action, so that the first locking member releases the constraint on the first unfolding assembly 4 to allow the first unfolding assembly 4 to unfold.

Figure 2:
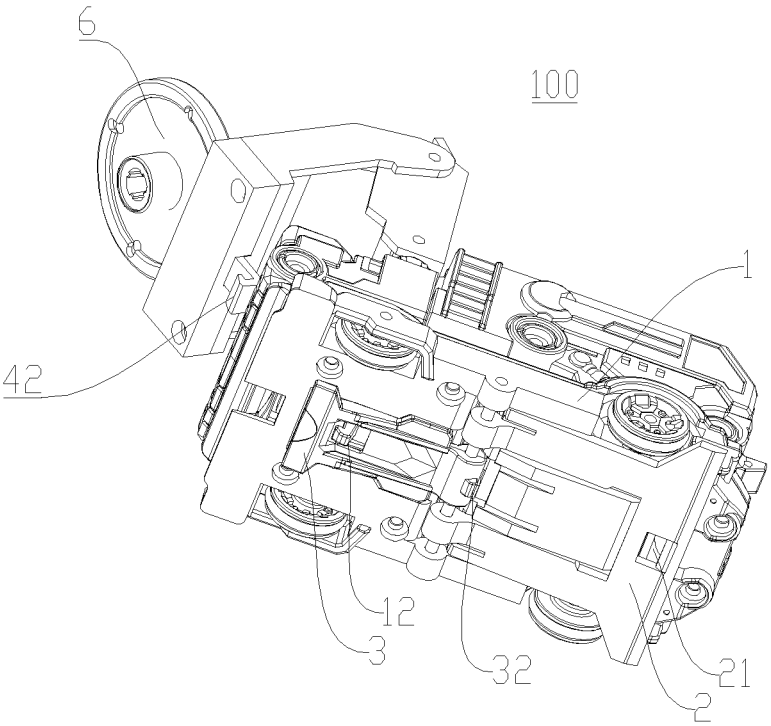
FIG. 2 illustrates a bottom perspective view of the toy in FIG. 1 after being triggered once.
Figure 3:
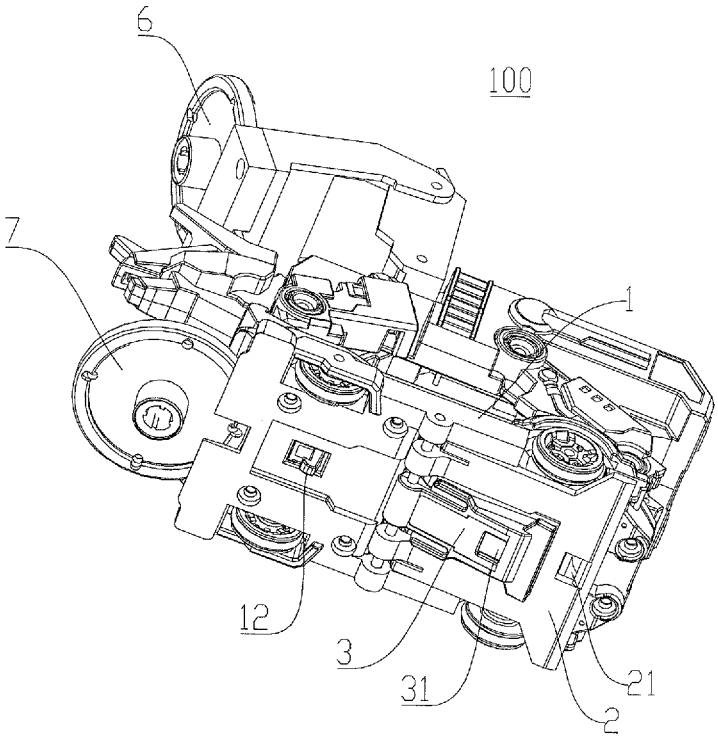
FIG. 3 illustrates a bottom perspective view of the toy in FIG. 1 after being triggered twice.
Figure 4:
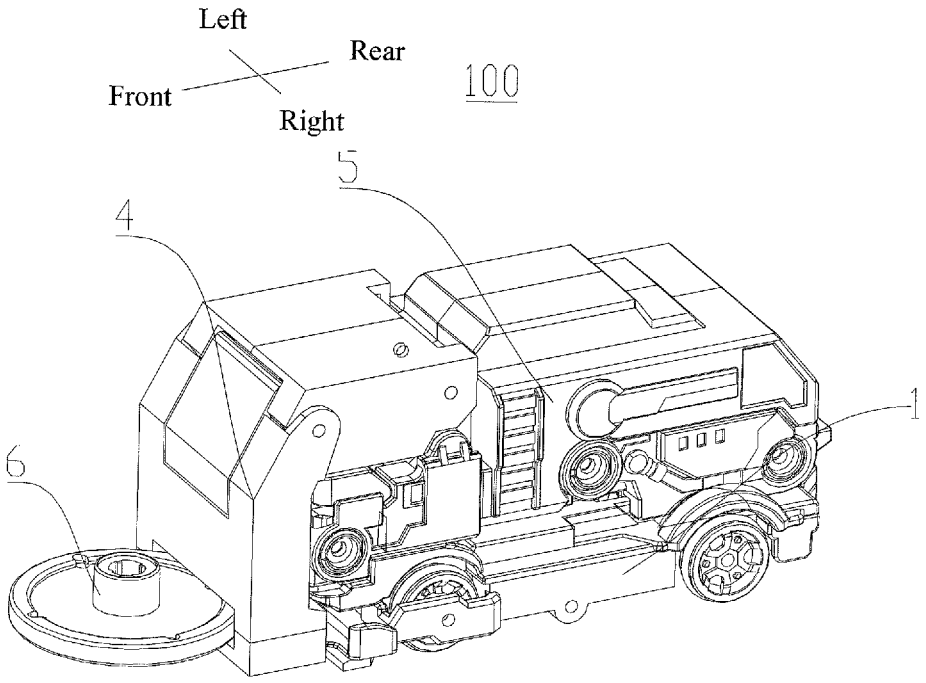
FIG. 4 illustrates a top perspective view of the toy in its original form shown in FIG. 1.
Figure 5:
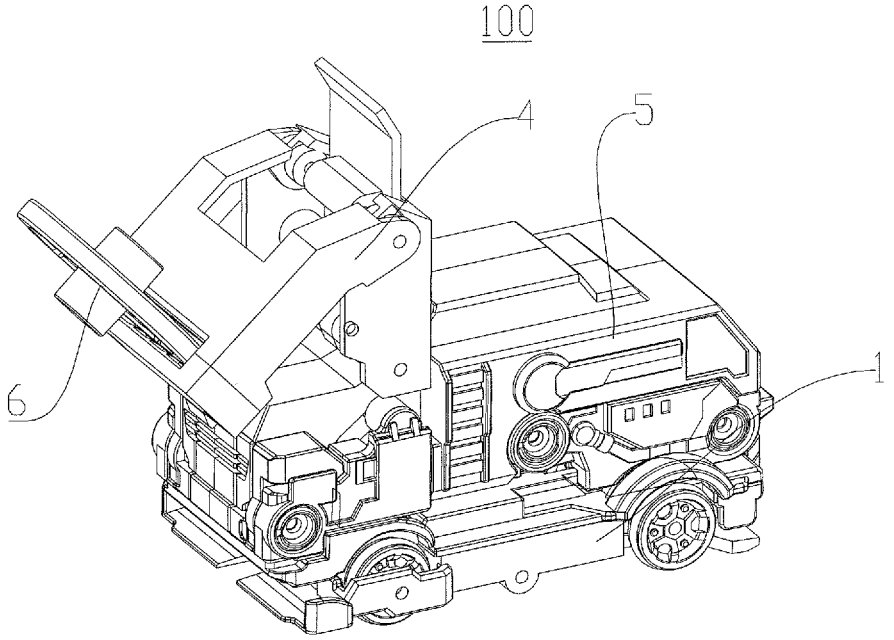
FIG. 5 illustrates a top perspective view of the toy in FIG. 4 after being triggered once.
Figure 6:
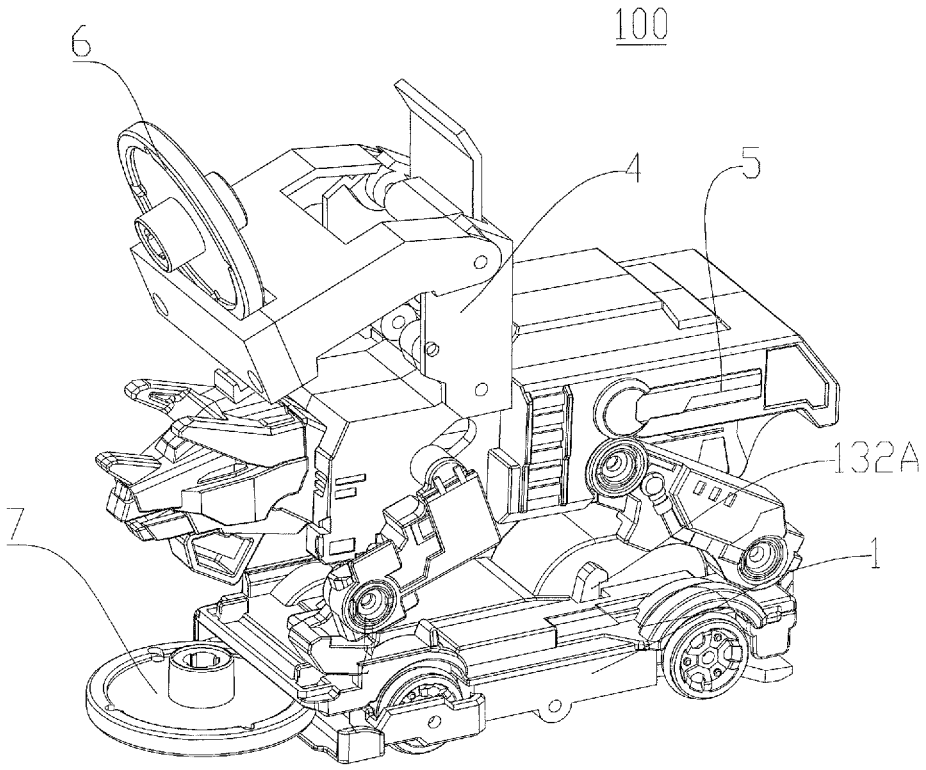
FIG. 6 illustrates a top perspective view of the toy in FIG. 4 after being triggered twice.
Figure 7:
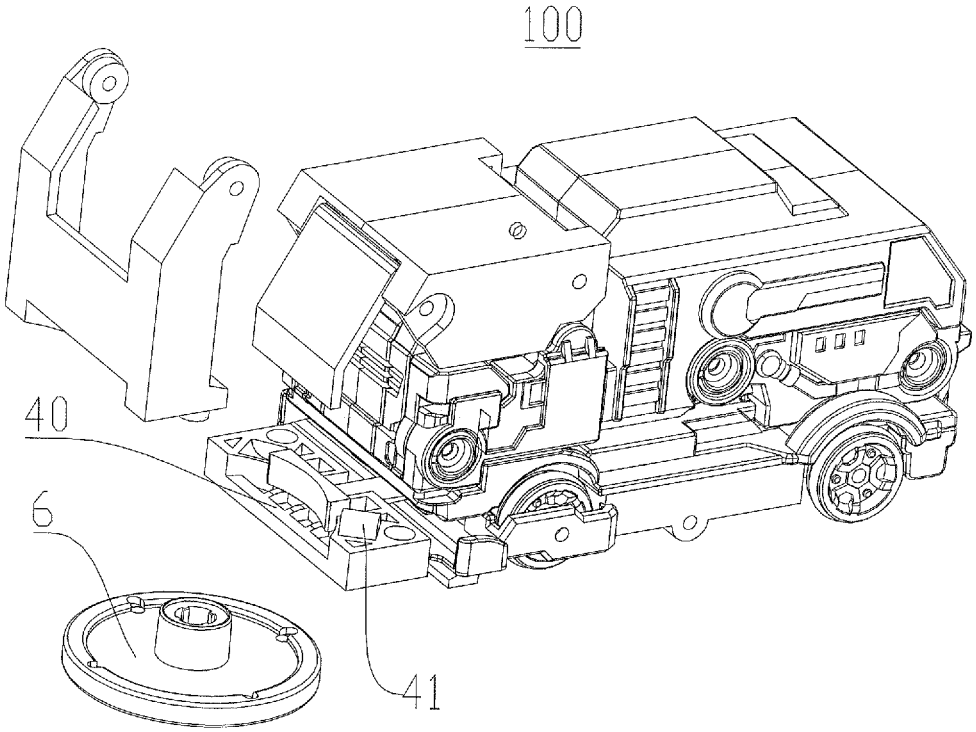
FIG. 7 illustrates a partial exploded view of the toy in FIG. 4.
Figure 8:
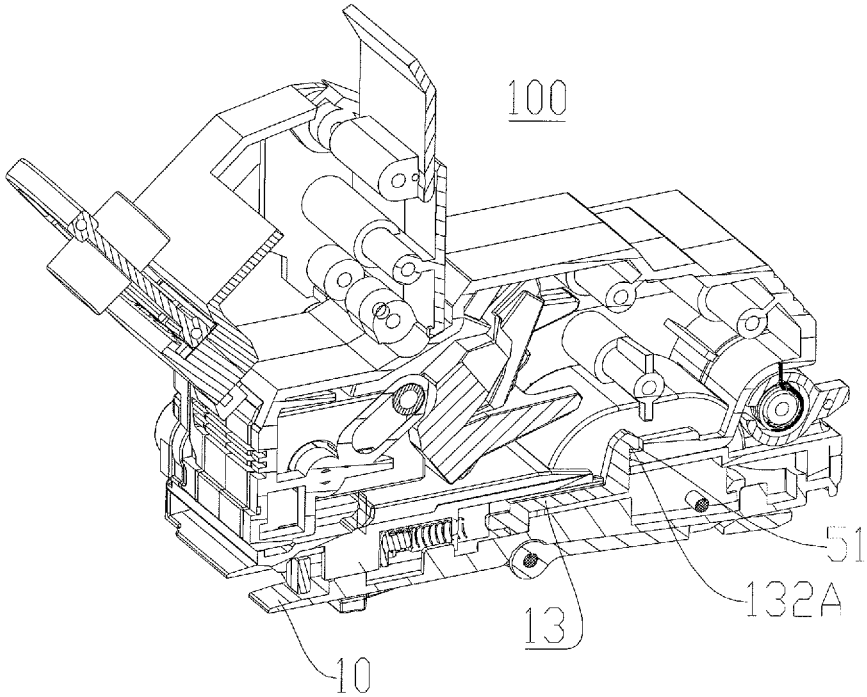
FIG. 8 illustrates a sectional view of the toy in FIG. 5.
Figure 9:
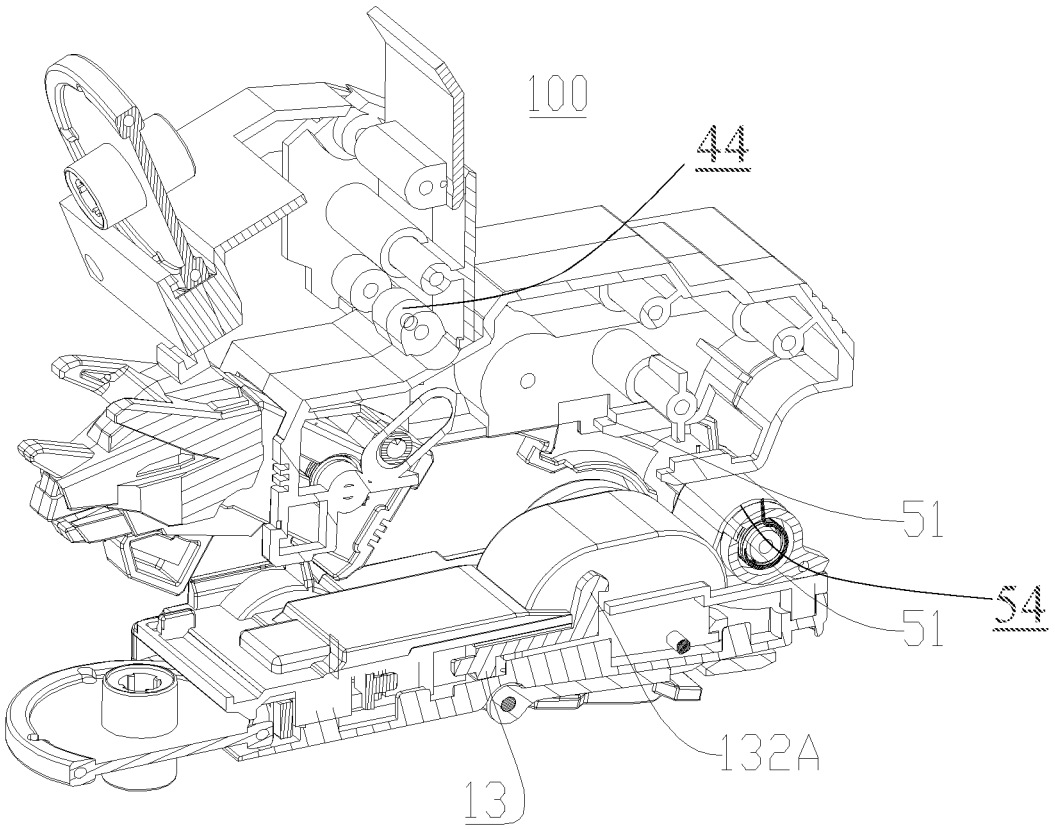
FIG. 9 illustrates a sectional view of the toy in FIG. 6.
Figure 10:
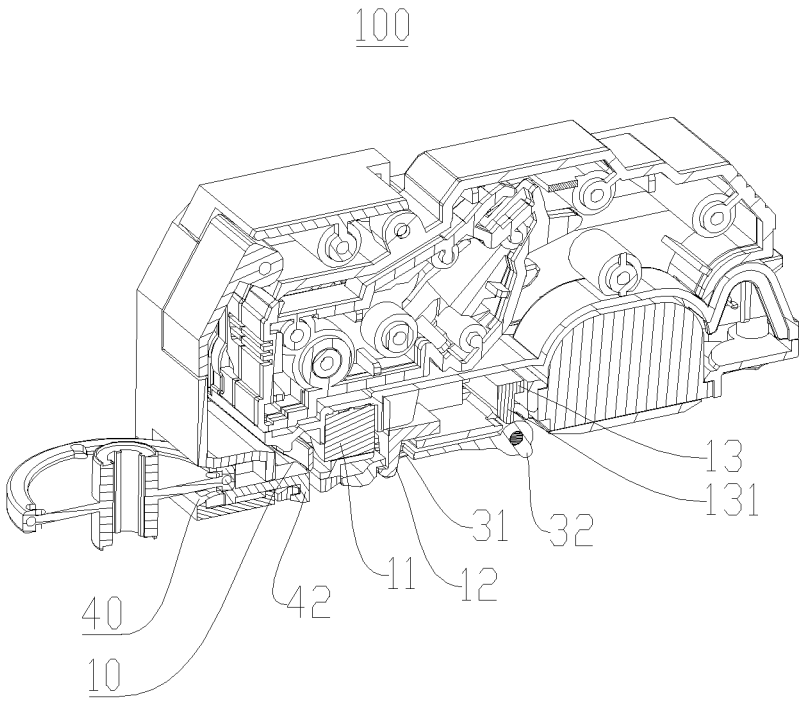
FIG. 10 illustrates a sectional view of the toy in FIG. 4.
Figure 11:
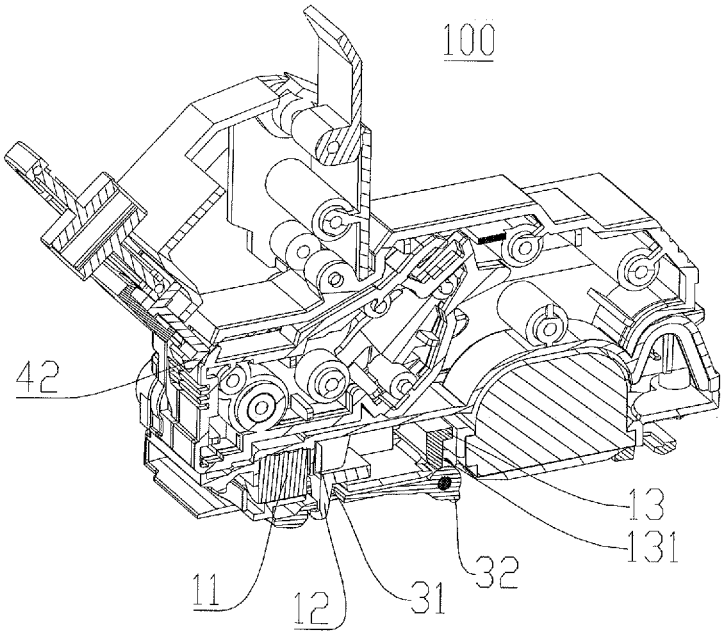
FIG. 11 illustrates another sectional view of the toy in FIG. 5.
Figure 12:
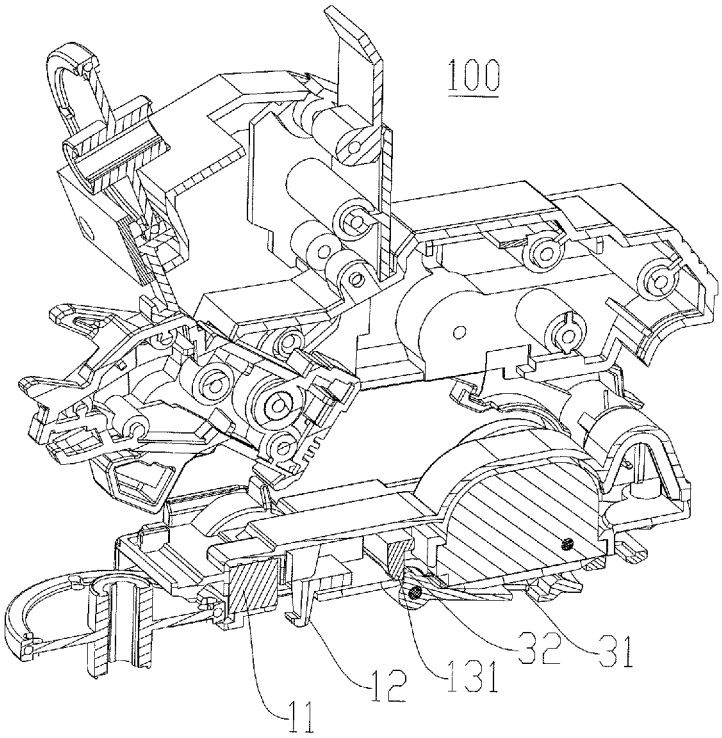
FIG. 12 illustrates another sectional view of the toy in FIG. 6.

In a specific example (as shown in a first embodiment below, referring to FIGS. 1-12), the bottom of the fixing member 1 has a lock hole 21. For instance, the lock hole 21 can be provided in the fixing member 1 or the first flipping member 2. The first locking member is configured as a lock hook 42 normally fitted with an edge of the lock hole 21 in a locked manner. When the first triggering member 41 is triggered, the first contact body 6 pushes the lock hook 42 out of the lock hole 21 to switch to the unlocked state.

For example, the first triggering member 41 may be a magnet and mounted in the first body portion, and the lock hook 42 can be mounted on the first body portion and movable in the front-and-back direction. When the first triggering member 41 attracts the first contact body 6 to move backwards, the first contact body 6 can push the lock hook 42 to move backwards. The lock hook 42 can correspond to the lock hole 21 after moving backwards, and hence is no longer constrained by the edge of the lock hole 21. At this time, the first unfolding assembly 4 can be unfolded under the action of the first elastic member 44. For example, the first unfolding assembly 4 can be unfolded into a shape of an upper body of a person sitting up straight.

Additionally, it should be noted that the phrase "the lock hook 42 normally fitted with the edge of the lock hole 21 in the locked manner" means that before the lock hook 42 is unlocked, the lock hook 42 is in a position where the lock hook 42 is permanently locked at the edge of the lock hole 21. For example, the lock hook 42 can be movably connected to the first body portion by a reset spring, and the reset spring flicks the lock hook 42 to make the lock hook 42 normally locked with the edge of the lock hole 21. When the first contact body 6 pushes the lock hook 42 to move backwards, the lock hook 42 can stretch or compress the reset spring, such that the reset spring is deformed and accumulates an elastic force. When the first triggering member 41 no longer attracts the first contact body 6, and the first unfolding assembly 4 is collapsed on the fixing member 1, the reset spring can push the lock hook 42 to be locked with the edge of the lock hole 21 again, and hence the first unfolding assembly 4 is locked again. Here, it should be noted that the ways in which the lock hook 42 and the edge of the lock hole 21 are locked and unlocked are as shown in the drawings, and belong to common knowledge, which will not elaborated herein.

Preferably, the lock hole 21 is formed in the first flipping member 2, such that the lock hook 42 is fitted with the edge of the lock hole 21 in the locked manner, which constrains the unfolding of the first unfolding assembly 4, and also constrains the pivotal movement of the first flipping member 2. Thus, when the lock hook 42 is separated from the lock hole 21, the first flipping member 2 no longer constraints the lock hook 42, in which case the first unfolding assembly 4 is unfolded; meanwhile, the lock hook 42 no longer constraints the first flipping member 2, in which case the first flipping member 2 pivots to allow the fixing member 1 to flip over in the air.

Figure 13:
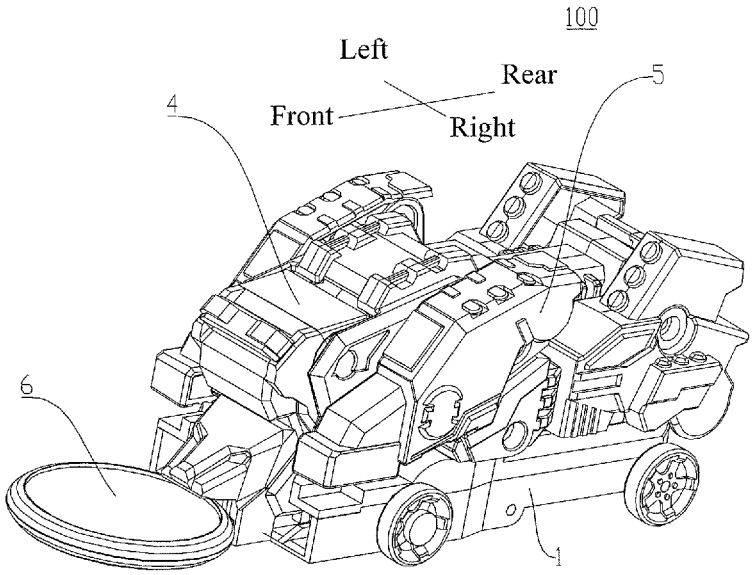
FIG. 13 illustrates a top perspective view of a toy in its original form according to a second embodiment of the present application.
Figure 14:
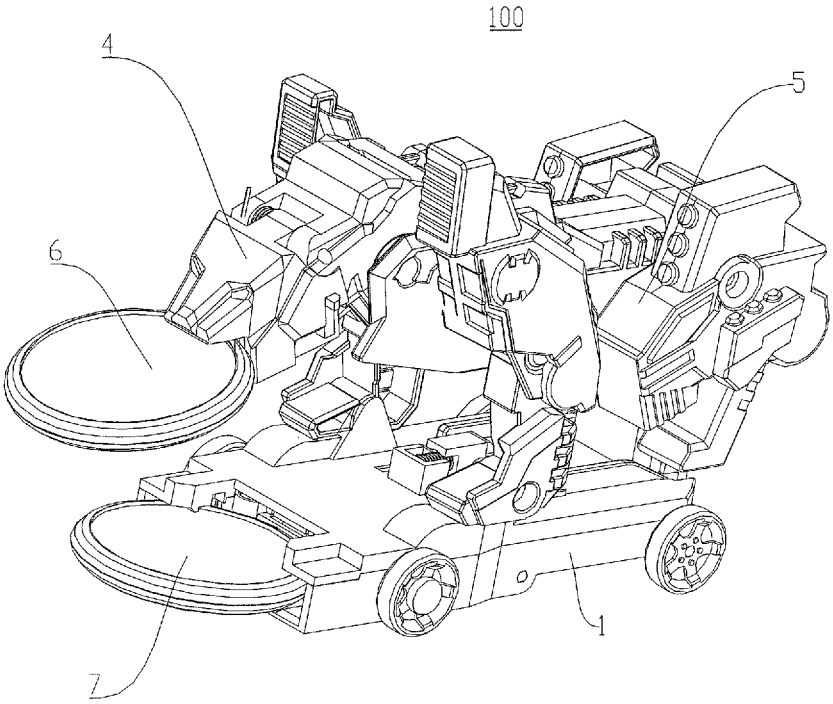
FIG. 14 illustrates a top perspective view of the toy in FIG. 13 after being triggered twice.
Figure 15:
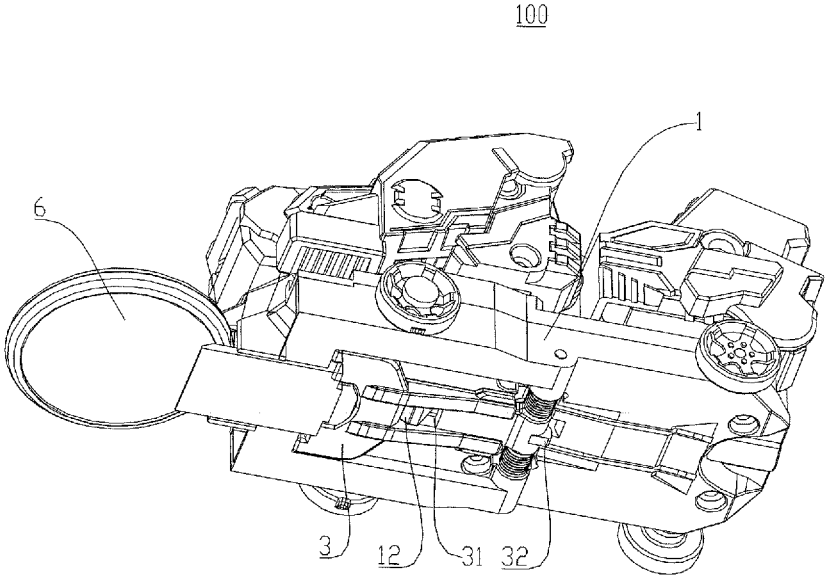
FIG. 15 illustrates a bottom perspective view of the toy in its original form shown in FIG. 13.
Figure 16:
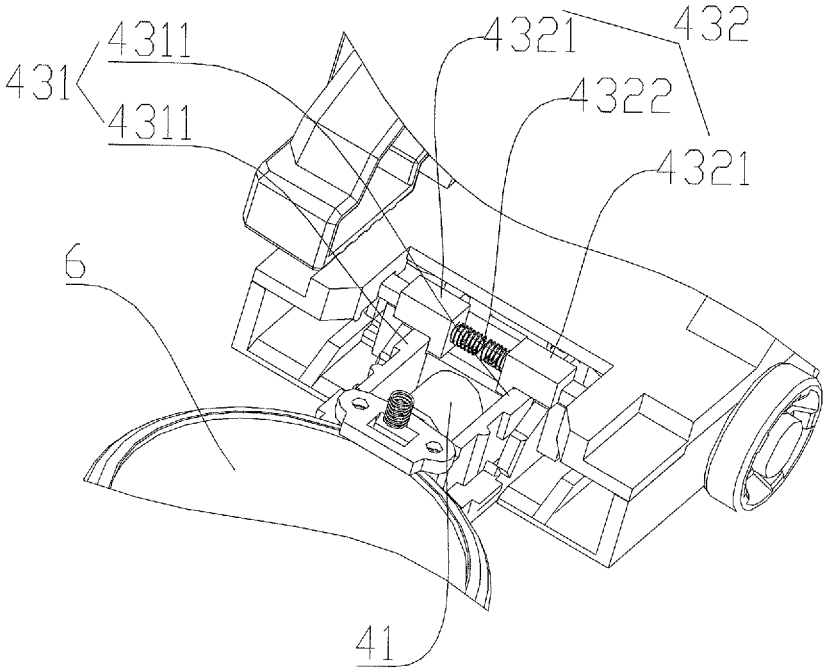
FIG. 16 illustrates a partial view of the toy in FIG. 13.
Figure 17:
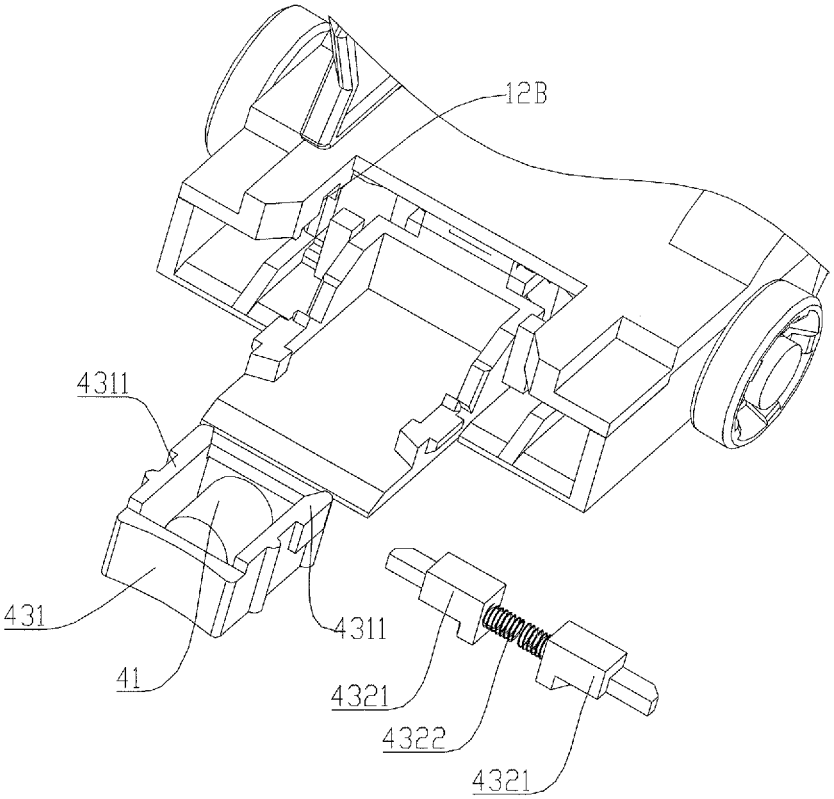
FIG. 17 illustrates an exploded view of the partial view of the toy shown in FIG. 16.
Figure 18:
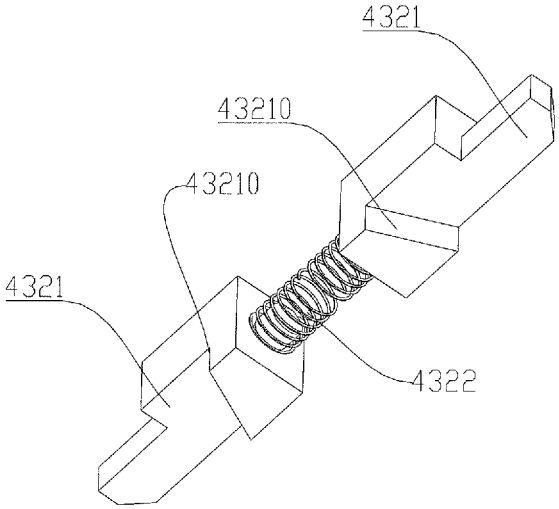
FIG. 18 illustrates a schematic view of a limiting block and an elastic member shown in FIG. 17.
Figure 19:
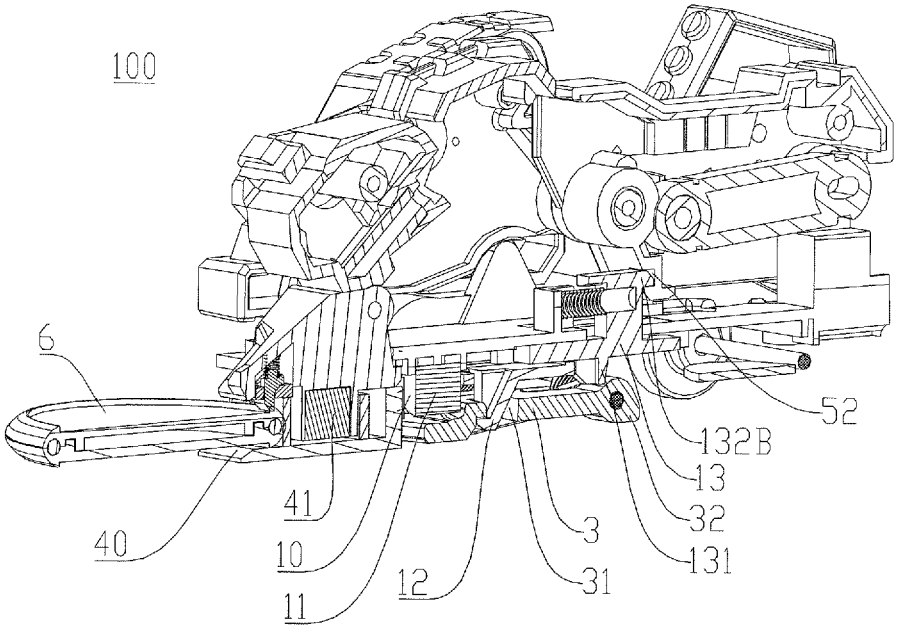
FIG. 19 illustrates a sectional view of the toy in FIG. 13.
Figure 20:
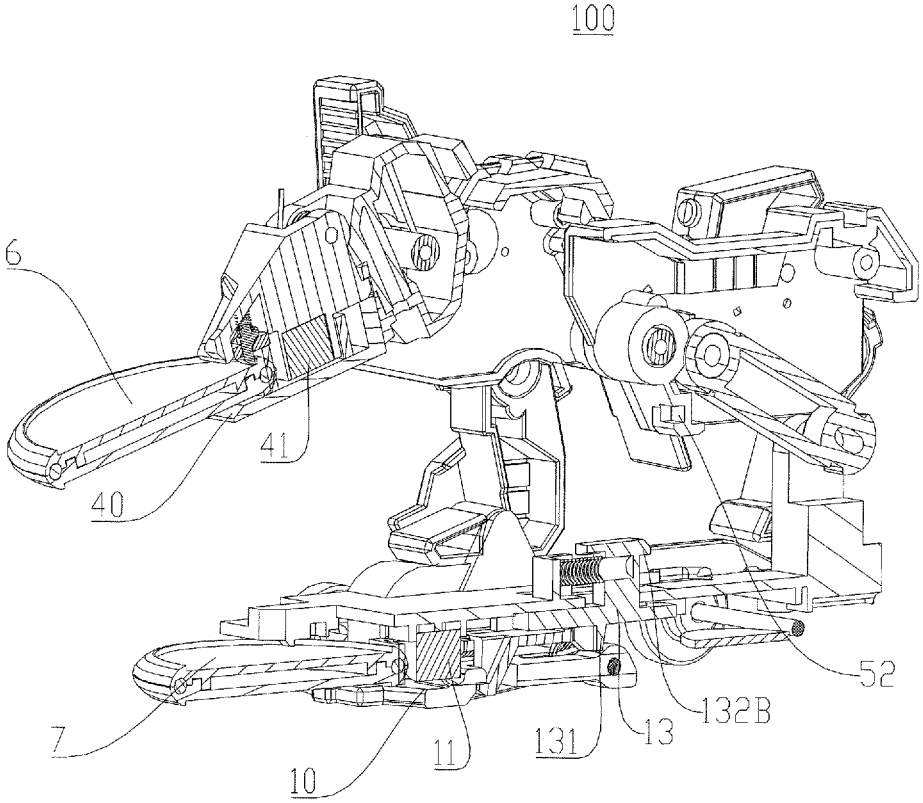
FIG. 20 illustrates a sectional view of the toy in FIG. 14, in which a second flipping member is in a locked state before being flipped over.

In another specific example (as shown in a second embodiment below, referring to FIGS. 13-20), the fixing member 1 is provided with a limiting groove 12B at each of left and right sides of the fixing member 1. The first locking member includes a limiting part 432 and a moving part 431. The limiting part 432 includes two limiting blocks 4321 spaced apart from each other in a left-and-right direction and an elastic member 4322 connected between the two limiting blocks 4321. The elastic member 4322 normally pushes the two limiting blocks 4321 apart from each other to cooperate with the two limiting grooves 12B to achieve locking. That is, when no external force is applied, the two limiting blocks 4321 cannot approach each other, and hence cannot be separated from the two limiting grooves 12B to achieve unlocking. When the moving part 431 pushes the two limiting blocks 4321, the two limiting blocks 4321 can compress the elastic member 4322 to approach each other, so as to be separated from the two limiting grooves 12B, respectively.

For example, the first triggering member 41 may be a magnet and mounted in the first body portion, and the moving part 431 can be mounted on the first body portion and movable in the front-and-back direction. When the first triggering member 41 attracts the first contact body 6 to move backwards, the first contact body 6 can push the moving part 431 to move backwards. During the backward movement of the moving part 431, the two limiting blocks 4321 are pushed to approach each other, that is, pushed towards a center of a connection line therebetween, such that the limiting block 4321 at the left side is separated from the limiting groove 12B at the left side, and the limiting block 4321 at the right side is separated from the limiting groove 12B at the right side, thereby getting rid of constraint from the limiting grooves 12B. At this time, the first unfolding assembly 4 can be unfolded under the action of the first elastic member 44. For example, the first unfolding assembly 4 can be unfolded into a shape of a lion's head.

It could be understood herein that by providing the elastic member 4322, when the first triggering member 41 no longer attracts the first contact body 6 to push the moving part 431 to move backwards, and the first unfolding assembly 4 is collapsed on the fixing member 1, the elastic member 4322 can push the two limiting blocks 4321 apart from each other to be fitted in the two limiting grooves 12B respectively. At this time, the two limiting blocks 4321 can be fitted in the two limiting grooves 12B respectively to realize the re-locking of the first unfolding assembly 4, and meanwhile, the moving part 431 can be pushed forwards to reset while the two limiting blocks 4321 are separated from each other in the left-and-right direction.

It should be noted that there are many implementations for pushing the two limiting blocks 4321 apart or pushing them together in the left-and-right direction by the forward and backward movement of the moving part 431, but only a relatively simple and reliable implementation is described herein. Specifically, each of the limiting blocks 4321 has a guide rail 43210, and the guide rail 43210 extends obliquely from the rear to the front towards a direction of a perpendicular bisector of the elastic member 4322. The moving part 431 has a pushing portion 4311 that is fitted with an outer side of the guide rail 43210 on each of the two limiting blocks 4321. When the pushing portion 4311 moves backwards along the guide rail 43210, the two limiting blocks 4321 are pushed to approach each other in the left-and-right direction.

Certainly, the present application is not limited thereto. For example, the moving part 431 and the limiting block 4321 may be provided with mutually attracted magnetic poles. For example, when the moving part 431 gradually extends backwards into between the two limiting blocks 4321, the moving part 431 can attract the two limit blocks 4321 to approach the moving part 431 simultaneously, so as to make the two limiting blocks 4321 approach each other in the left-and-right direction.

Specific implementations about the triggering of the second triggering member 11, the unlocking of the third locking member, the pivoting of the second flipping member 3, the unlocking of the second locking member, and the unfolding of the second unfolding assembly 5 according to embodiments of the present application will be briefly described below.

First, an implementation where "the second flipping member 3 pivots and the fixing member 1 is flipped over in the air when the second triggering member 11 is triggered by the second contact body 7" will be briefly introduced, but the present application is certainly not limited to this implementation.

The fixing member 1 can have a second clamping aperture 10 in its front end, and the second triggering member 11 (e.g., a magnet) may be fixedly provided to a rear side of the second clamping aperture 10. The third locking member is configured as a hook 12 that is provided to the rear side of the second clamping aperture 10 and movable relative to the fixing member 1 in the front-and-rear direction. The second flipping member 3 is pivotally provided to the bottom of the fixing member 1 and interacts with the fixing member 1 through a second torsion spring 33. The second flipping member 3 has a hole 31, and the hook 12 is normally fitted with an edge of the hole 31 in a locked manner through a spring.

When the second triggering member 11 and the second contact body 7 are magnetically attracted to each other, the second triggering member 11 is triggered. In such a case, at least one of the second triggering member 11 and the second contact body 7 may move towards a direction close to each other. When the second triggering member 11 is stationary with respect to the fixing member 1, the second triggering member 11 can attract the second contact body 7 to move backwards, such that the second contact body 7 can push the hook 12 to move backwards synchronously to be separated from the edge of the hole 31 and comes out of the hole 31. At this time, the second flipping member 3 pivots under the action of the second torsion spring 33, and during the pivoting of the second flipping member 3, the toy 100 can be flipped over in the air through the interaction between a free end of the second flipping member 3 and the supporting surface.

Next, an implementation where "the second unfolding assembly 5 is triggered to unfold during the pivoting of the second flipping member 3" will be briefly introduced, but the present application is certainly not limited to this implementation.

Specifically, the toy 100 further includes the second locking member that is movably provided to the fixing member 1. The second locking member is switchable between a locking state where the second locking member cooperates with the second unfolding assembly 5 in a locked manner to fold the second unfolding assembly 5 and an unlocking state where the second locking member is separated from the second unfolding assembly 5 to unfold the second unfolding assembly 5.

That is, the second locking member is switchable between the locking state and the unlocking state. When the second locking member assumes the locking state, the second locking member cooperates with the second unfolding assembly 5 in the locked manner to constrain the second unfolding assembly 5, such that the second unfolding assembly 5 can assume the collapsed state. When the second locking member assumes the unlocking state, the second locking member is separated from the second unfolding assembly 5 to release the constraint on the second unfolding assembly 5, such that the second unfolding assembly 5 can assume the unfolded state.

For example, the second unfolding assembly 5 has a second snapping member (such as a first snapping hole 51 in the first embodiment, a second snapping hole 52 in the second embodiment, and a snapping groove 53 in the third embodiment described below). The second locking member is configured as a moving member 13 having a first snapping member (such as a first snapping hook 132A in the first embodiment, a second snapping hook 132B in the second embodiment, a snapping piece 132C in the third embodiment described below) and a first toggling portion 131. The moving member 13 is movably connected with the fixing member 1 through a spring or the like. The first snapping member normally cooperates with the second snapping member, that is, the first snapping member is not separated from the second snapping member when no external force is applied to the moving member 13.

A pivot shaft of the second flipping member 3 is provided with a second toggling portion 32. During the pivoting of the second flipping member 3, the second toggling portion 32 can toggle the first toggling portion 131 to move forwards, such that the first toggling portion 131 drives the moving member 13 to move forwards. During the forward movement of the moving member 13, the first snapping member moves forwards along with the moving member 13, so as to come out of the second snapping member. At this time, the second unfolding assembly 5 is not constrained and can be unfolded under the action of the second elastic member 54. In addition, since the moving member 13 is connected with the fixing member 1 through a spring or the like, the moving member 13 can be reset automatically to lock the second unfolding assembly 5 in the collapsed state again, thereby improving the entertainment of the toy 100.

The toy 100 according to three specific embodiments of the present application will be briefly described below, in which the toy 100 is a toy capable of implementing second coin clamping.

First Embodiment

Referring to FIGS. 1-12, the toy 100 includes the fixing member 1, the first flipping member 2 and the second flipping member 3 both provided to the bottom of the fixing member 1, the second unfolding assembly 5 provided on the fixing member 1, and the first unfolding assembly 4 provided on the second unfolding assembly 5.

When the first unfolding assembly 4 and the second unfolding assembly 5 are both collapsed on the fixing member 1, the toy 100 as a whole presents a car shape. When the first triggering member 41 is triggered, the first flipping member 2 pivots, the fixing member 1 is back-flipped, and the first unfolding assembly 4 can be unfolded into a shape of a human being. When the second triggering member 11 is triggered, the second flipping member 3 pivots, the fixing member 1 is back-flipped, and the second unfolding assembly 5 can be unfolded into a shape of an animal.

In this way, in a case where the toy 100 is in the first form (for example, a vehicle type), when the first triggering member 41 in the first clamping aperture 40 attracts the first contact body 6 (i.e., after the toy 100 realizes the coin clamping once), the first contact body 6 pushes the lock hook 42 to move backwards, the lock hook 42 is separated from the lock hole 21 in the first flipping member 2, and the first unfolding assembly 4 is unfolded and lifted to expose the second clamping aperture 10 and the second triggering member 11. At the same time, the first flipping member 2 pivots, and the fixing member 1 is back-flipped. When the second triggering member 11 in the second clamping aperture 10 attracts the second contact body 7 (that is, after the toy 100 realizes the second coin clamping), the second contact body 7 pushes the hook 12 to move backwards, and in turn the hook 12 is separated from the hole 31 in the second flipping member 3, such that the second flipping member 3 pivots to cause the fixing member 1 to be back-flipped. Meanwhile, the second flipping member 3 pushes the moving member 13 forwards, and the first snapping hook 132A of the moving member 13 is separated from the first snapping hole 51, such that the second unfolding assembly 5 is unfolded, and the toy 100 presents the second form (e.g., a form of a man riding an animal).

Therefore, the toy 100 is highly entertaining, and when the toy 100 is switched from the second form to the first form, it only takes two steps to collapse. Moreover, the toy 100 also has a function of avoiding hitting hands, and hence has high safety.

Second Embodiment

Referring to FIGS. 13-20, the toy 100 includes the fixing member 1, the second flipping member 3 provided to the bottom of the fixing member 1, the second unfolding assembly 5 provided on the fixing member 1, and the first unfolding assembly 4 provided on the second unfolding assembly 5. When the first unfolding assembly 4 and the second unfolding assembly 5 are both collapsed on the fixing member 1, the toy 100 as a whole presents a car shape. When the first triggering member 41 is triggered, the first unfolding assembly 4 can be unfolded into a shape of an animal head. When the second triggering member 11 is triggered, the second flipping member 3 pivots, the second triggering member 11 is back-flipped, and the second unfolding assembly 5 can be formed into a shape of an animal body and limbs.

In this way, in a case where the toy 100 is in the first form (for example, a vehicle type), when the first triggering member 41 in the first clamping aperture 40 attracts the first contact body 6 (i.e., after the toy 100 realizes the coin clamping once), the first contact body 6 pushes the moving part 431 to move backwards, the moving part 431 in turn pushes the two limiting blocks 4321 to approach each other in the left-and-right direction so as to be separated from the two limiting grooves 12B, such that the first unfolding assembly 4 is unfolded and lifted to expose the second clamping aperture 10 and the second triggering member 11. When the second triggering member 11 in the second clamping aperture 10 attracts the second contact body 7 (that is, after the toy 100 realizes the second coin clamping), the second contact body 7 pushes the hook 12 to move backwards, and in turn the hook 12 is separated from the hole 31 in the second flipping member 3, such that the second flipping member 3 pivots to allow the fixing member 1 to be back-flipped. Meanwhile, the second flipping member 3 pushes the moving member 13 forwards, and the second snapping hook 132B of the moving member 13 is separated from the second snapping hole 52, such that the second unfolding assembly 5 is unfolded, and the toy 100 presents the second form (e.g., a lion form).

Therefore, the toy 100 is highly entertaining, and when the toy 100 is switched from the second form to the first form, it only takes two steps to collapse. Moreover, the toy 100 also has a function of avoiding hitting hands, and hence has high safety.

Third Embodiment

Referring to FIGS. 21-26, the toy 100 include the fixing member 1, the second flipping member 3 provided to the bottom of the fixing member 1, the second unfolding assembly 5 provided on the fixing member 1, and the first unfolding assembly 4. When the first unfolding assembly 4 and the second unfolding assembly 5 are both collapsed on the fixing member 1, the toy 100 as a whole presents a car shape. When the first triggering member 41 is triggered, the first unfolding assembly 4 can be unfolded into a shape of a scorpion body and tail. When the second triggering member 11 is triggered, the second flipping member 3 pivots, the second triggering member 11 is back-flipped, and the second unfolding assembly 5 can be formed into a shape of two scorpion arms.

In this way, in a case where the toy 100 is in the first form (for example, a vehicle type), when the first triggering member 41 in the first clamping aperture 40 attracts the first contact body 6 (i.e., after the toy 100 realizes the coin clamping once), the first triggering member 41 drives the movable snapping member 433 to move forwards to come out forwardly from the lower side of the limiting baffle 12C, such that the first unfolding assembly 4 is unfolded and lifted to expose the second clamping aperture 10 and the second triggering member 11. When the second triggering member 11 in the second clamping aperture 10 attracts the second contact body 7 (that is, after the toy 100 realizes the second coin clamping), the second contact body 7 pushes the hook 12 to move backwards, and in turn the hook 12 is separated from the hole 31 in the second flipping member 3, such that the second flipping member 3 pivots to allow the fixing member 1 to be back-flipped. Meanwhile, the second flipping member 3 pushes the moving member 13 forwards, and the left and right snapping pieces 132C of the moving member 13 are separated from the snapping grooves 53 in the left and right branch portions 50 of the second unfolding assembly 5 respectively, such that the two branch portions 50 of the second unfolding assembly 5 are unfolded leftwards and rightwards, and the toy 100 presents the second form (e.g., a scorpion form).

Therefore, the toy 100 is highly entertaining, and when the toy 100 is switched from the second form to the first form, it only takes two steps to collapse. Moreover, the toy 100 also has a function of avoiding hitting hands, and hence has high safety.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or position relationship as shown in the drawings under discussion. These relative terms are only for convenience and simplicity of description, and do not indicate or imply that the referred device or element must have a particular orientation or be constructed or operated in a particular orientation. Thus, these terms shall not be construed to limit the present application.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present application, the term "a plurality of" means two or more than two, unless specified otherwise.

In the present application, unless specified or limited otherwise, the terms "mounted," "connected," "coupled," "fixed" and the like are used broadly, and may be, for example, direct connections or indirect connections via intervening structures; may also be inner communication or mutual interaction of two elements, which can be understood by those skilled in the art according to specific situations.

In the present application, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via intervening structures. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present application. Thus, the appearances of the phrases throughout this specification are not necessarily referring to the same embodiment or example. Furthermore, the particular features, structures, materials, or characteristics may be combined in any suitable manner in one or more embodiments or examples. In addition, those skilled in the art can integrate and combine different embodiments or examples as well as features in different embodiments or examples, without any contradiction.

Although embodiments of the present application have been shown and described, it would be appreciated by those skilled in the art that various changes, modifications, alternatives and variations can be made to the above embodiments of the present application without departing from the principle of the present application. The scope of the present application is defined by the claims and the like.

What is claimed is:

1. A toy comprising:

a first unfolding assembly comprising: a first aperture in a front end of the first unfolding assembly, a first triggering member provided adjacent to the first aperture and in a triggerable state, a first elastic member, and a first locking member; and a frame comprising a second aperture in a front end of the frame, and a second triggering member provided adjacent to the second aperture, wherein the first unfolding assembly is foldably disposed on the frame and connected to the frame by the first elastic member, and the first unfolding assembly covers the second aperture and the second triggering member, wherein the first locking member is switchable between a locking state and an unlocking state; in the locking state, the first locking member cooperates with the frame in a locked manner, the first elastic member is compressed, and the first unfolding assembly is folded; in the unlocking state, the first locking member is separated from the frame, the first elastic member releases an elastic force, and the first unfolding assembly is unfolded under the action of the elastic force, and wherein when the first triggering member is triggered, the first locking member switches to the unlocking state, and the first unfolding assembly is unfolded such that the second aperture is exposed and the second triggering member is triggerable; and wherein the frame is provided with a limiting groove in each of a left side and a right side of the frame; and the first locking member comprises:

a limiting part, comprising two limiting blocks spaced apart from each other in a left-and-right direction, and an elastic member connected between the two limiting blocks, the elastic member normally pushing the two limiting blocks away from each other to be fitted with the two limiting grooves respectively, so as to achieve locking; and a moving part, configured in such a way that when the moving part pushes the two limiting blocks, the two limiting blocks compress the elastic member to approach each other to be separated from the two limiting grooves respectively to achieve unlocking.

2. The toy according to claim 1, further comprising a first contact body, wherein the first contact body and the first triggering member are both magnetically attractable; when the first triggering member and the first contact body are magnetically attracted to each other, the first triggering member is triggered by the first contact body and the first contact body is attracted into the first aperture; when the first triggering member is triggered, one of the first contact body and the first triggering member is moved relative to the frame to drive the first locking member to switch to the unlocking state.

3. The toy according to claim 2, further comprising a lock hole located below the frame, wherein the first locking member is configured as a lock hook normally fitted with an edge of the lock hole in the locked manner, and when the first triggering member is triggered, the first contact body pushes the lock hook out of the lock hole to unlock.

4. The toy according to claim 3, further comprising a first flipping member pivotally provided to a bottom of the frame and connected to the frame by a torsion spring, wherein the lock hole is provided in the first flipping member; the torsion spring is compressed when the lock hook is fitted with the edge of the lock hole; and when the first triggering member is triggered, the torsion spring releases an elastic force, and the first flipping member pivots under the action of the elastic force to allow the frame to flip over in the air.

5. The toy according to claim 1, wherein the frame has a limiting baffle, the first locking member is configured as a movable snapping member normally abutting against under the limiting baffle, and when the first triggering member is triggered, the first triggering member drives the movable snapping member to be separated from under the limiting baffle to unlock.

6. The toy according to claim 1, wherein each of the limiting blocks has a guide rail extending obliquely from the rear to the front towards a direction close to a perpendicular bisector of the elastic member; the moving part is provided with a pushing portion fitted with an outer side of the guide rail of each of the limiting blocks; the pushing portion pushes the two limiting blocks to approach each other in the left-and-right direction when moving backwards along the guide rail.

7. The toy according to claim 1, further comprising a second contact body, wherein the second contact body and the second triggering member are both magnetically attractable; and when the second triggering member and the second contact body are magnetically attracted to each other, the second triggering member is triggered by the second contact body, and the second contact body is attracted into the second aperture.

8. The toy according to claim 7, further comprising: a second flipping member pivotally provided to a bottom of the frame and connected to the frame by a second torsion spring; and a hook provided to a rear side of the second aperture and movable relative to the frame in a front-and-rear direction, wherein the second flipping member has a hole normally fitted with the hook, and the second torsion spring is compressed, wherein when the second triggering member is triggered, the second contact body pushes the hook to move backwards to be separated from the hole, the second torsion spring releases an elastic force, and the second flipping member pivots under the action of the elastic force to allow the frame to flip over in the air.

9. The toy according to claim 8, further comprising a second locking member movably provided to the frame and configured as a moving member; and a second unfolding assembly configured to be foldable and disposed on the frame, wherein the moving member has a first snapping member and a first toggling portion, wherein the second unfolding assembly comprises a second snapping member and a second elastic member and is connected to the frame by the second elastic member, and the second flipping member has a second toggling portion, wherein the moving member is switchable between a locking state and an unlocking state; in the locking state, the first snapping member normally cooperates with the second snapping member, the second elastic member is compressed, and the second unfolding assembly is folded; in the unlocking state, the first snapping member is separated from the second snapping member, the second elastic member releases an elastic force, and the second unfolding assembly is unfolded under the action of the elastic force, and wherein when the second flipping member pivots, the second toggling portion toggles the first toggling portion to move forwards, the first snapping member is driven to move forwards, and the moving member switches to the unlocking state.

10. The toy according to claim 9, wherein the second snapping member is configured as a snapping hole, and the first snapping member is configured as a snapping hook, wherein while the second flipping member pivots to allow the frame to flip over in the air, the second flipping member pushes the moving member forwards, and the snapping hook of the moving member is separated from the snapping hole, such that the second unfolding assembly is unfolded.

11. The toy according to claim 9, wherein the second snapping member is configured as a snapping groove in the branch portion, and the first snapping member is configured as a snapping piece, wherein while the second flipping member pivots to allow the frame to flip over in the air, the second flipping member pushes the moving member forwards, and the snapping piece of the moving member is separated from the snapping groove, such that the second unfolding assembly is unfolded.

12. A toy comprising:

a first unfolding assembly comprising: a first aperture in a front end of the first unfolding assembly, a first triggering member provided adjacent to the first aperture and in a triggerable state, a first elastic member, and a first locking member; and a frame comprising a second aperture in a front end of the frame, and a second triggering member provided adjacent to the second aperture, wherein the first unfolding assembly is foldably disposed on the frame and connected to the frame by the first elastic member, and the first unfolding assembly covers the second aperture and the second triggering member, wherein the first locking member is switchable between a locking state and an unlocking state; in the locking state, the first locking member cooperates with the frame in a locked manner, the first elastic member is compressed, and the first unfolding assembly is folded; in the unlocking state, the first locking member is separated from the frame, the first elastic member releases an elastic force, and the first unfolding assembly is unfolded under the action of the elastic force, and wherein when the first triggering member is triggered, the first locking member switches to the unlocking state, and the first unfolding assembly is unfolded such that the second aperture is exposed and the second triggering member is triggerable;

wherein the toy further comprises a second contact body, wherein the second contact body and the second triggering member are both magnetically attractable; and when the second triggering member and the second contact body are magnetically attracted to each other, the second triggering member is triggered by the second contact body, and the second contact body is attracted into the second aperture;

wherein the toy further comprises a second flipping member pivotally provided to a bottom of the frame and connected to the frame by a second torsion spring; and a hook provided to a rear side of the second aperture and movable relative to the frame in a front-and-rear direction, wherein the second flipping member has a hole normally fitted with the hook, and the second torsion spring is compressed, and wherein when the second triggering member is triggered, the second contact body pushes the hook to move backwards to be separated from the hole, the second torsion spring releases an elastic force, and the second flipping member pivots under the action of the elastic force to allow the frame to flip over in the air.

13. The toy according to claim 12, further comprising a second locking member movably provided to the frame and configured as a moving member; and a second unfolding assembly configured to be foldable and disposed on the frame, wherein the moving member has a first snapping member and a first toggling portion, wherein the second unfolding assembly comprises a second snapping member and a second elastic member and is connected to the frame by the second elastic member, and the second flipping member has a second toggling portion, wherein the moving member is switchable between a locking state and an unlocking state; in the locking state, the first snapping member normally cooperates with the second snapping member, the second elastic member is compressed, and the second unfolding assembly is folded; in the unlocking state, the first snapping member is separated from the second snapping member, the second elastic member releases an elastic force, and the second unfolding assembly is unfolded under the action of the elastic force, and wherein when the second flipping member pivots, the second toggling portion toggles the first toggling portion to move forwards, the first snapping member is driven to move forwards, and the moving member switches to the unlocking state.

14. The toy according to claim 13, wherein the second snapping member is configured as a snapping hole, and the first snapping member is configured as a snapping hook, wherein while the second flipping member pivots to allow the frame to flip over in the air, the second flipping member pushes the moving member forwards, and the snapping hook of the moving member is separated from the snapping hole, such that the second unfolding assembly is unfolded.

15. The toy according to claim 13, wherein the second snapping member is configured as a snapping groove in the branch portion, and the first snapping member is configured as a snapping piece, wherein while the second flipping member pivots to allow the frame to flip over in the air, the second flipping member pushes the moving member forwards, and the snapping piece of the moving member is separated from the snapping groove, such that the second unfolding assembly is unfolded.

* * * * *